US006365202B1

(12) United States Patent
Ida et al.

(10) Patent No.: US 6,365,202 B1
(45) Date of Patent: Apr. 2, 2002

(54) PNEUMATIC SQUEEZABLE NURSING BOTTLE AND PROCESS OF USING

(76) Inventors: Frank Ida, 1 Jillit Dr., Smithtown, NY (US) 11787; Luciano DiScala, 111 Arpage Dr. East, Shirley, NY (US) 11967

( * ) Notice: Subject to any disclaimer, the term of this patent is extended or adjusted under 35 U.S.C. 154(b) by 0 days.

(21) Appl. No.: 09/418,302

(22) Filed: Oct. 14, 1999

Related U.S. Application Data

(63) Continuation-in-part of application No. 08/991,368, filed on Dec. 16, 1997, now Pat. No. 6,042,850, which is a continuation-in-part of application No. 08/517,709, filed on Aug. 21, 1995, now Pat. No. 5,699,920.

(51) Int. Cl.[7] ..... A51J 9/00

(52) U.S. Cl. ..... 426/2; 426/115; 426/117; 215/11.1; 215/11.3; 215/11.4; 215/11.5; 215/11.6

(58) Field of Search ..... 426/117, 115; 215/11.1, 11.3, 11.4, 11.5, 11.6, 11.7

(56) References Cited

U.S. PATENT DOCUMENTS

| | | | | |
|---|---|---|---|---|
| 362,554 | A | | 5/1887 | Suydam |
| 985,328 | A | | 2/1911 | Decker |
| 1,037,309 | A | | 9/1912 | Poore |
| 1,998,646 | A | | 4/1935 | Yager |
| 2,110,928 | A | | 3/1938 | De Buys |
| 2,394,722 | A | | 2/1946 | Sloane |
| 2,469,489 | A | | 5/1949 | Allen et al. |
| 2,550,210 | A | | 4/1951 | Vance, Jr. |
| 2,624,485 | A | | 1/1953 | Boston |
| 2,793,778 | A | | 5/1957 | Maxwell |
| 2,804,995 | A | | 9/1957 | Fee |
| 2,846,103 | A | | 8/1958 | Maxwell |
| 3,162,318 | A | | 12/1964 | Woodberry, Jr. |
| 3,232,467 | A | | 2/1966 | Barton |
| 3,292,808 | A | | 12/1966 | Green |
| 3,511,407 | A | | 5/1970 | Palma |
| 3,648,873 | A | | 3/1972 | Grobbel |
| 3,718,140 | A | | 2/1973 | Yamauchi |
| 3,768,682 | A | | 10/1973 | Meyers et al. |
| 3,768,683 | A | | 10/1973 | Van Den Bosch |
| 3,822,806 | A | * | 7/1974 | Grimes ..... 215/11 E |
| 3,955,698 | A | | 5/1976 | Hammer |
| 3,998,348 | A | | 12/1976 | Sammaritano |
| 4,010,861 | A | | 3/1977 | Welten |
| 4,020,978 | A | | 5/1977 | Szczepanski |
| 4,176,745 | A | | 12/1979 | Miller |
| 4,241,768 | A | | 12/1980 | Keller et al. |
| 4,295,582 | A | | 10/1981 | Acres |
| 4,339,046 | A | | 7/1982 | Coen |
| 4,401,224 | A | | 8/1983 | Alonso |
| 4,466,547 | A | | 8/1984 | Klittich |
| 4,469,250 | A | | 9/1984 | Evezich |
| 4,545,491 | A | | 10/1985 | Bisgaard et al. |
| 4,613,050 | A | | 9/1986 | Atkin et al. |
| 4,657,151 | A | | 4/1987 | Cabernoch |
| 4,676,387 | A | | 6/1987 | Stephenson et al. |
| 4,730,744 | A | | 3/1988 | Vinciguerra |
| 4,821,896 | A | | 4/1989 | Cheng |
| 4,828,126 | A | | 5/1989 | Vincinguerra |
| 4,842,165 | A | | 6/1989 | Van Coney |
| 4,880,125 | A | | 11/1989 | LeBleau |
| 4,928,836 | A | | 5/1990 | Wu et al. |

(List continued on next page.)

FOREIGN PATENT DOCUMENTS

| | | |
|---|---|---|
| EP | 0009460 | 2/1980 |

*Primary Examiner*—Milton I. Cano
*Assistant Examiner*—H. Mai

(57) ABSTRACT

A method of feeding an infant utilizing a nursing bottle, having a resilient shell body with at least one aperture, a flexible liner, and a feeding nipple that utilizes air pressure to expel trapped air from a liner. That when the aperture or apertures are covered by the operator's finger or hand, and pressure is applied to the shell body, air trapped in the liner can be expelled prior to feeding the infant.

11 Claims, 2 Drawing Sheets

U.S. PATENT DOCUMENTS 4,944,418 A 7/1990 Wallace
4,979,629 A 12/1990 Askerneese
5,033,631 A 7/1991 Nightingale
5,069,351 A 12/1991 Gunderson
5,109,996 A 5/1992 Sullivian
5,211,299 A * 5/1993 Mantredonia ..... 215/11.1
5,284,261 A 2/1994 Zambuto
5,301,825 A 4/1994 Di Scala et al.
5,318,204 A 6/1994 Davis et al.
5,332,121 A * 7/1994 Schmidt et al. ..... 222/95
5,356,016 A 10/1994 Wiedemann
5,431,290 A 7/1995 Vinciguerra
5,499,729 A 3/1996 Greenwood et al.
5,524,783 A 6/1996 Popoff
5,687,861 A * 11/1997 Wiedeman ..... 215/11.3
5,699,920 A 12/1997 Ida et al.
5,921,426 A * 7/1999 Randolph ..... 220/495.06
6,042,850 A * 3/2000 Ida et al. ..... 426/2

* cited by examiner

PNEUMATIC SQUEEZABLE NURSING BOTTLE AND PROCESS OF USING

RELATED APPLICATION

This is a continuation-in-part of application Ser. No.08/991,368 filed on Dec. 16, 1997 which now U.S. Pat. No. 6,042,850, which is a continuation-in-part of application Ser. No. 08/517,709 filed on Aug. 21, 1995, now U.S. Pat. No. 5,669,920.

The present invention relates to nursing bottles utilizing air pressure to expel air from disposable liners and the method of using such bottles for feeding an infant. A baby feeding from a nursing bottle often ingests air that is trapped in the liner of a nursing bottle. This air ends up in the baby's stomach and can cause pain and regurgitation. The elimination of the air from the liner prevents the baby from ingesting the air and so reduces the possibility of the negative side effects associated with air in the baby's stomach.

BACKGROUND OF THE INVENTION

The problem of air in a disposable liner of nursing bottles has been recognized for some time. The prior art disclose devices that are used to eliminate air from the liner. For example, the prior art disclose the use of plungers, such as those disclosed in U.S. Pat. No. 5,524,783 to Popoff, U.S. Pat. No. 4,880,125 to LeBleau, and U.S. Pat. No. 3,648,873 to Grobbel. The end of the plunger is used to mechanically collapse the liner toward a nipple on the nursing bottles that cause a decrease in volume of the liner. As the liquid in the liner moves upward in response to the mechanical pressure from the plunger, the air in the liner is expelled through the nipple. A similar device is disclosed in U.S. Pat. No. 4,176,745 to Miller that has a pneumatic member that applies a force to a liner to expel air in the liner. The problem with all these devices is they require extra parts that are cumbersome to operate and an added expense to manufacture.

Other prior art disclosed in U.S. Pat. No. 5,687,861 to Wiedemann, and U.S. Pat. No. 5,921,426 to Randolph are simply, soft shell body nursers that when pressure is applied to the shell body, the shell body, because of direct contact, applies pressure to the liner, and forces the trapped air in the liner through the nipple. This works well only when the liner is full. When there is any volume of contents less than full, it is increasingly more difficult to squeeze. If either of these devices is placed to rest during the feeding, and air enters the liner it becomes very difficult, to almost impossible, to remove the air and continue feeding. The aperture in these devices, is for the sole purpose of allowing air to freely flow in and out between the liner and the shell body.

Prior art disclosed in U.S. Pat. No. 5,699,920 to Ida et.al. of which is the parent patent of this application, is the first soft nurser that when pressure is applied, air is removed from the liner. It, however, employs a valve that serves to make the air flow into the bottle automatic, a good, but not always necessary function that adds to the cost of manufacturing, and servicing over the life of use of the product.

Prior art disclosed in U.S. Pat. No. 2,804,995 to Fee and U.S. Pat. No. 4,020,978 to Szczepanski are basically container devices that dispense product, but do not teach, or even suggest, a benefit of feeding an infant with such a device. Also there is no suggestion or purpose of inherently limiting the use of these devices to adults only, by the application of multiple apertures.

SUMMARY OF THE INVENTION

Accordingly, it is an object of the present invention to teach the method of removing air from the liner prior to feeding, of a nursing bottle, providing a nursing bottle, especially intended for infants, which utilizes air pressure to collapse a liner and expel air from the liner via the nipple without the use of a valve, or any other mechanical parts.

It is another object of the present invention to provide a nursing bottle, which promotes upright feeding by keeping the nipple full of liquid during feeding.

It is another object of the present invention to provide nursing bottle that is easy to use, maintain, and operate.

It is a further object of the present invention to provide a nursing bottle that is economically and easily manufactured for widespread sale and use.

Certain of the foregoing and related objects are readily obtained in the following method of feeding an infant in which the method comprises the steps of providing a nurser comprising; a shell body having an open end and at least one aperture, a feeding nipple attachable to the open end of the body, a flexible liner suspendable from the open end of the body so as to create a chamber between the liner and the body, apertures apertures coverable by the operators hand, finger, or fingers for restricting the flow of air from the chamber, filling the liner with a liquid, covering aperture or apertures, squeezing the shell body until all the trapped air is forced out of the liner, and feeding the liquid through the nipple to the infant. Furthermore, the placement of multiple apertures, for the purpose of deterring a toddler from squirting the contents from the nurser, should be considered.

BRIEF DESCRIPTION OF THE DRAWINGS

Other objects and features of the present invention will become apparent from the following detailed description considered in connection with the accompanying drawings that disclose the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
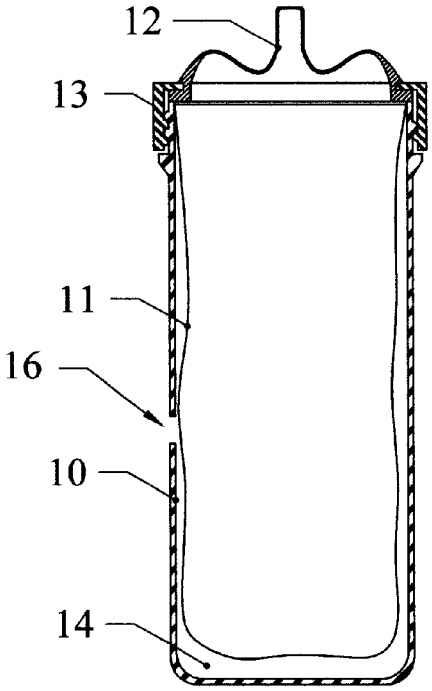
FIG. 1 is a cross-sectional view of one embodiment of the nursing bottle.

Referring to FIG. 1, the structure of the nursing can be seen. The nursing bottle is preferably made of plastic (e.g., a random co-polymer of the polypropylene family) and has a resilient body 10 that has an open upperend an aperture 16. The open upper end of body 10 is connected to a nipple 12 having an orifice 18, preferably made of latex or silicone rubber. Preferably, orifice 18 of nipple 12 is self-sealing, however, its relative small size allows it to not have to seal. Intermolecular cohesion of the liquid contents sufficiently seals the orifice 18. Desirably, nipple 12 is connectable to body 10 by a screw-on retaining ring 13. Retaining ring 13 includes internal threads that mate with external threads on body 10. Secured between the mating threads is a pouch or bag-like liner 11 that holds liquid. The space between liner 11 and body 10 defines a chamber 14.

Figure 3:
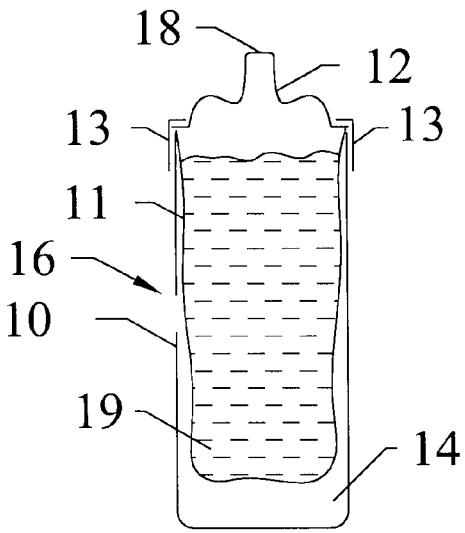
FIG. 3 is a cross-sectional view of the nursing bottle shown in FIG. 1 in an initial state with liquid and air in the liner, e.g. prior to feeding.
Figure 4:
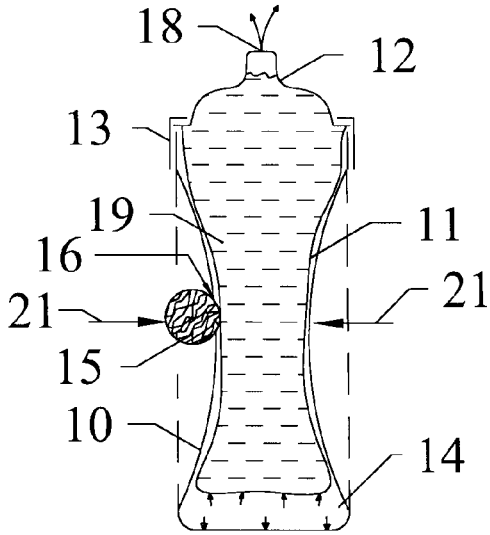
FIG. 4 is a cross-sectional view of the nursing bottle shown in FIG. 3 in which the nursing bottle is squeezed, with a finger placed over the aperture, so that the liquid in the liner rises and the air is expelled from the liner.

The operation of nursing bottle is best shown with reference to FIGS. 3–6. FIG. 3 shows the nursing bottle with liner 11 initially filled with liquid 19 and air. FIG. 4 illustrates the nursing bottle, with the operator's finger 15 covering aperture 16 and forces 21 applying pressure to body 10, e.g., manually squeezing body. As shown in FIG. 4, body 10 is in a collapsed state. As body 10 is collapsed, the size of chamber 14 decreases. Air cannot escape chamber 14 through aperture 16 because the operator's finger 15 seals the aperture 16. The increased pressure in chamber 14 acts on liner 11 causing liquid 19 in the liner to rise. This causes the air in the liner to be expelled through orifice 18 in nipple 12.

Figure 5:
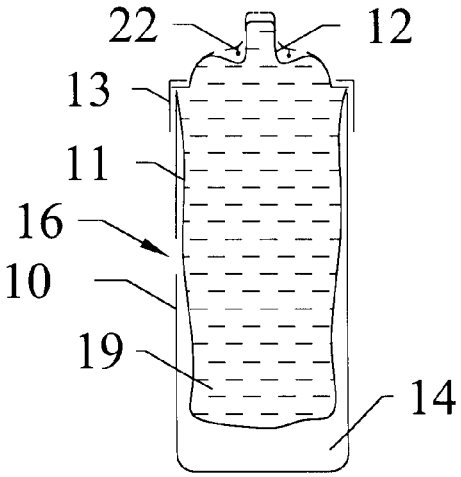
FIGS. 5 is a cross-sectional view of the nursing bottle shown in FIG. 4 in which the body of the nursing bottle is returning to its initial state.
Figure 6:
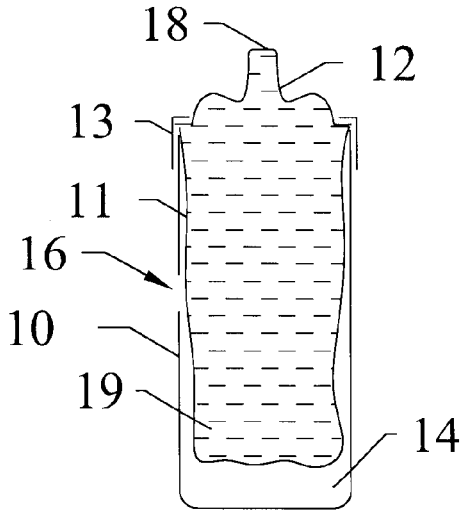
FIG. 6 is a cross-sectional view of the nursing bottle shown in FIG. 5 with the body returned to its initial state and no air in the liner.

Turning now to FIG. 5, the operation of the nursing bottle when the pressure is released can be seen. With liner 11 collapsed and the air in liner 11 expelled, liner 11 occupies a smaller volume than it previously did before application of forces 21. As body 10 expands, the air pressure in the chamber 14 equalizes with the pressure outside body 10 when the operator uncovers the aperture. As seen in FIG.6, after this process, liner 11 contains no air and is ready for feeding to an infant. As will be appreciated to those skilled in the art, as the baby feeds from the nursing bottle, the volume of liner 11 decreases and the volume of chamber 14 increases and air is draw into chamber 14freely to allow for a steady flow of liquid through orifice 18.

Figure 2:
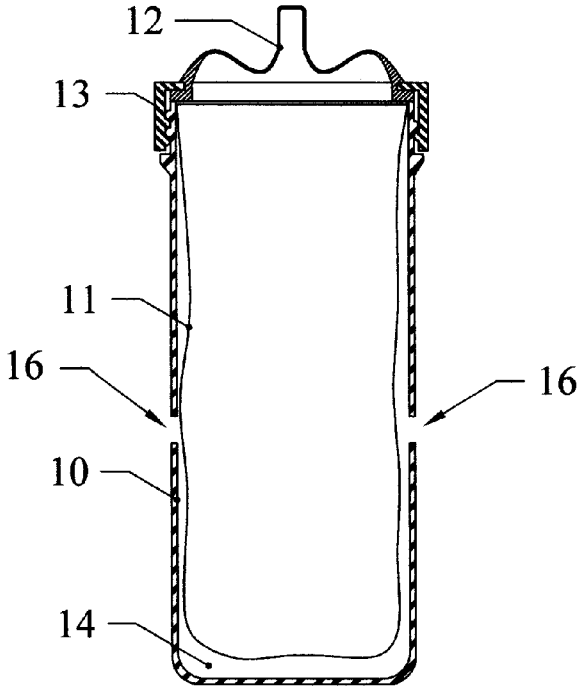
FIG. 2 is an alternate embodiment of the present invention with two apertures.

From the present invention it will be appreciated to those skilled in the art that the aperture 16 need not be placed in a specific place, but can be placed, in any convenient handling location, including the bottom or, as seen in FIG. 2 multiple apertures 16 spaced apart from one another, in such a manor, that the dimensions of a toddlers hand would make it very difficult for a toddler to operate. For example, FIG. 2 depicts two apertures 16 diametrically opposed on the body of the bottle so the circumference of the bottle hinders the toddler's grasp and ability to expel liquid on their own. A built in tamper resistance.

Thus, while only two embodiments of the present invention have been shown and described, many changes and modifications may be made relative thereto without departing from the spirit and scope of the invention.

What is claimed is:

1. A method of feeding an infant, said method comprising;

providing a nursing bottle comprising;

a body having an open end and at least one aperture;

a flexible liner suspendable from said open end of said body so as to create a chamber between said liner and said body;

a feeding nipple attachable to said open end of said body;

an aperture in said body coverable by an operator's hand, or finger for restricting the flow of air from the chamber;

filling the liner with a liquid, covering the aperture, and applying pressure to the body forcing air trapped in the liner, through the nipple until the liquid is in the nipple(;) releasing the operator's hand or finger from the aperture to permit the body to expand and the pressure in the chamber to equalize with the outside pressure; and feeding the bottle to an infant.

2. The bottle according to claim 1, further comprising a retaining ring for attaching said nipple to said body.

3. The bottle according to claim 1, wherein the nipple is self-sealing.

4. A method of feeding an infant, said method comprising;

providing a nursing bottle comprising;

a body having an open end and multiple apertures;

a flexible liner suspendable from said open end of said body so as to create a chamber between said liner and said body;

a feeding nipple attachable to said open end of said body;

apertures in said body coverable to by the operators hand and finger, or fingers for restricting the flow of air from the chamber;

filling the liner with a liquid, covering the apertures, and applying pressure to the body, forcing air trapped in the liner, through the nipple until the liquid is in the nipple(;) releasing the operator's hand or finger from the aperture to permit the body to expand and the pressure in the chamber to equalize with the outside pressure; and feeding the bottle to an infant.

5. The bottle according to claim 4, containing two or more apertures to hinder the operation of the bottle by a toddler.

6. The bottle according to claim 4, further comprising a retaining ring for attaching said nipple to said body.

7. The bottle according to claim 4, wherein the nipple is self-sealing.

8. A nursing bottle comprising:

a body having an open end and a sidewall;

a flexible liner suspendable from the open end of the body so as to create a chamber between the liner and the body;

said body containing two or more apertures in the wall separated by a distance that the small hand of a toddler cannot simultaneously cover and squeeze and the apertures are coverable by an operator's hand or fingers for restricting the flow of air from the chamber;

filling the liner with a liquid, covering the apertures, and applying pressure to the body, forcing air trapped in the liner, through the nipple until the liquid is in the nipple; and releasing the operator's hand or fingers from the aperture to permit the body to expand and the pressure in the chamber to equalize with the outside pressure.

9. The bottle according to claim 8, further comprising a retaining ring for attaching said nipple to said body.

10. The bottle according to claim 8, wherein the nipple is self-sealing.

11. The bottle according to claim 8, wherein the body having an open end and multiple apertures located on the sidewalls of the body.

* * * * *